United States Patent [19]

Skillman

[11] 4,033,068

[45] July 5, 1977

[54] STRUCTURAL MODULE

[76] Inventor: Jack J. Skillman, 727 E. 60th St., Chicago, Ill. 60637

[22] Filed: Sept. 8, 1975.

[21] Appl. No.: 611,346

[52] U.S. Cl. ..... 46/1 L; 428/542; 46/154

[51] Int. Cl.[2] ..... A63H 33/16; A42B 1/18

[58] Field of Search ..... 273/155; 46/1 L, 154; 428/542

[56] References Cited

OTHER PUBLICATIONS

Albarn Publication, received Feb. 10, 1967.
Creative Life with Creative Orgami, Tokoy, 1969.
Mathematical Models, The Clarendon Press, received 1968.
Paper Folding for Beginners, received June 7, 1965.

*Primary Examiner*—Hugh R. Chamblee
*Assistant Examiner*—Robert F. Cutting

[57] ABSTRACT

A folded structural module form includes an oppositely disposed pair of points and interior pockets which enable adjacent modules to be put together to make a geometrical form by slipping the points of one module into the pockets of another module. By varying the numbers of modules used, the manner in which they are inserted, and by use of other assembly techniques, a great variety of different structures may be produced. The modules and the forms produced thereby are useful as educational devices, scientific models, decorations, furnishings, toy, and construction units.

14 Claims, 21 Drawing Figures

STRUCTURAL MODULE

This invention relates to structural modules made primarily from folded sheet materials and more particularly to a use of such modules in any of many different ways in order to make a great variety of polyhedra and other geometrical structures.

Primarily, the modular device and the techniques, methods, and processes described herein relate to origami, the Japanese art of process of paper folding. However, it should be understood that the principles of the invention may be practiced through a use of many different kinds of materials other than paper, which may also be folded. For example, certain thin sheets of plastic, metal, woven material, or the like, may be folded to form relatively strong modules which may then be assembled into structural forms. Hereinafter, for convenience of expression, all of these and any other suitable material are generically and collectively called "paper"; although the invention is not limited to paper, per se.

Likewise, the origami arts do relate to folding. However, once the folded modules are produced, they may be copied in molded plastic, pressed materials, or the like. Hence, a plastic injection molding may be made to incorporate all of the principles of the modules described herein. Thus, the term "fold" is herein intended to cover not only the original concept of folding, per se, but also all other methods of fabrication or duplication, without regard to whether it is done by a punch press, or the like.

The following description presents an orderly sequence of folding for arriving at certain crease lines that arrange the paper in a modular form. Obviously, a different sequence could be followed to arrive at essentially the same arrangements of crease lines. Therefore, the fact that I have described initial parallel folds followed by triangular folds does not preclude an initial triangular fold followed by parallel folding. In a like manner, any of the sequences may be interchanged in a suitable manner.

The principles of the invention lead to many different structural forms which may be assembled from the same modules and used for any of a great variety of purposes. For example, the module may form the basis of children's construction toys (similar to Tinker Toys), erection sets, or cluster toys. The module might serve as an intellectual or manipulative challenge, somewhat similar to the use of a jigsaw puzzle. The inventive module is also useful as an educational device or tool in teaching geometrical forms, chemical models, or arithmetic models and fractional units. The inventive modules may also be used to make decoration, space sculpture, ornaments or the like. They might also be assembled into a basic building block form for constructing a geodesic dome, or the like. Hence, there are many uses for the inventive structural module. One advantage of the invention is that modules may be assembled at a location of usage, thereby saving both excess charges and losses from damage in handling. They may also be stacked, stored or shipped in a tasselated or mosaiced array.

Accordingly, an object of the invention is to provide a new and improved module of the described type, having general utility for fabricating any of a great varity of structures. In this connection, an object of the invention is to provide relatively small modular devices which can be pre-fabricated and shipped in a compact form, to be assembled on site into a relatively large and non-compact form. Here, an object is to provide a module which may be used by designers as a tool or an aid for forming any of a plurality of different structural devices.

Still another object is to provide useful tools in such diverse fields as educational aids, toys, construction, packaging, and the like.

In keeping with an aspect of the invention, these and other objects are accomplished by providing a structural module that constitutes a set of four triangles made from a folded sheet form. A plurality of points and pockets are formed on the module so that they may be slipped into each other to form one or more sequential and uniform segments of a large polyhedron. Depending upon whether the sheet form is folded into a set of four right triangular tapered sections or an array of four equilateral triangular sections, the polyhedron may be either stellated or pierced. Hence, the inventive module provides means for making a variety of devices, having general utility for a great variety of purposes.

The nature of the invention will become more apparent from a study of the attached drawings wherein.

Figure 7:
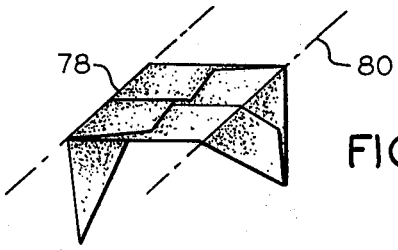
Figure 8:
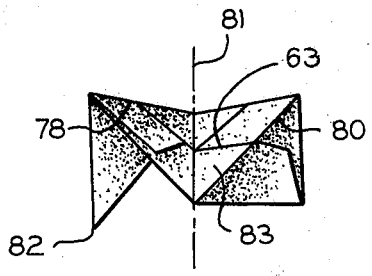
Figure 6:
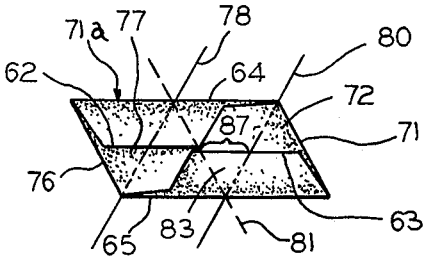
Figure 9:
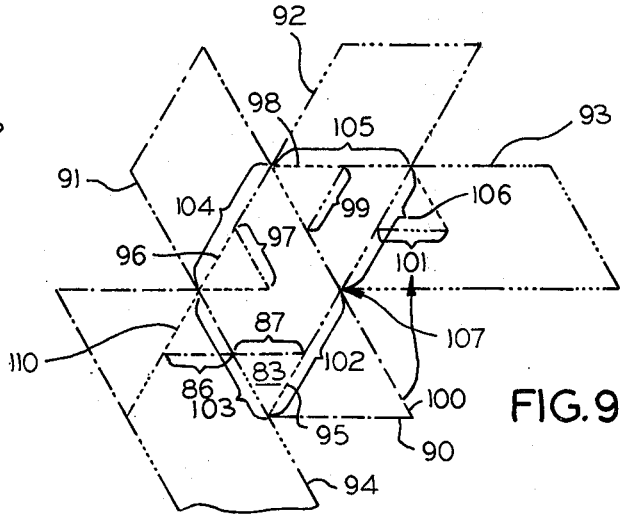
Figure 10:
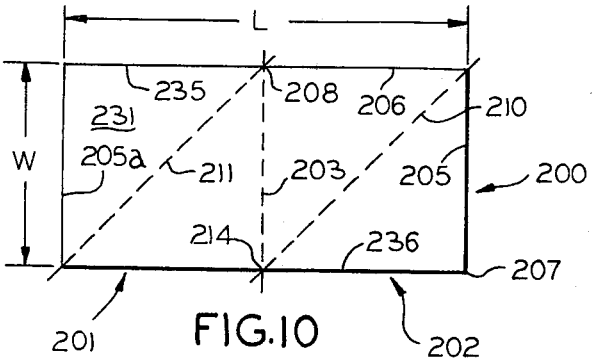
Figure 16:
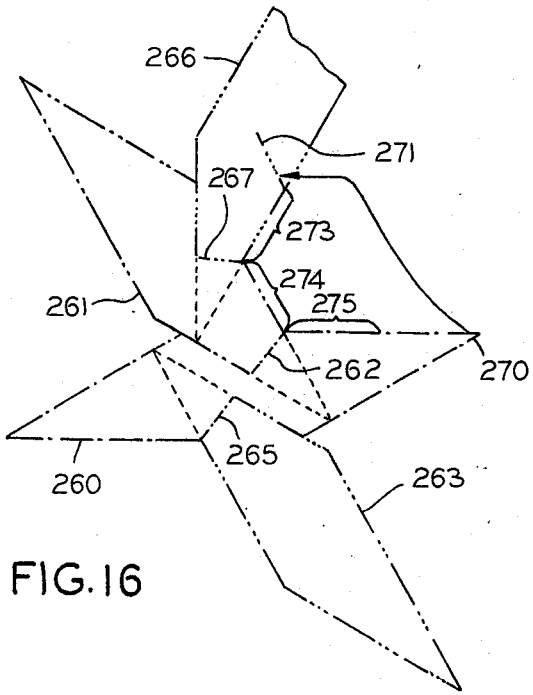
Figure 17:
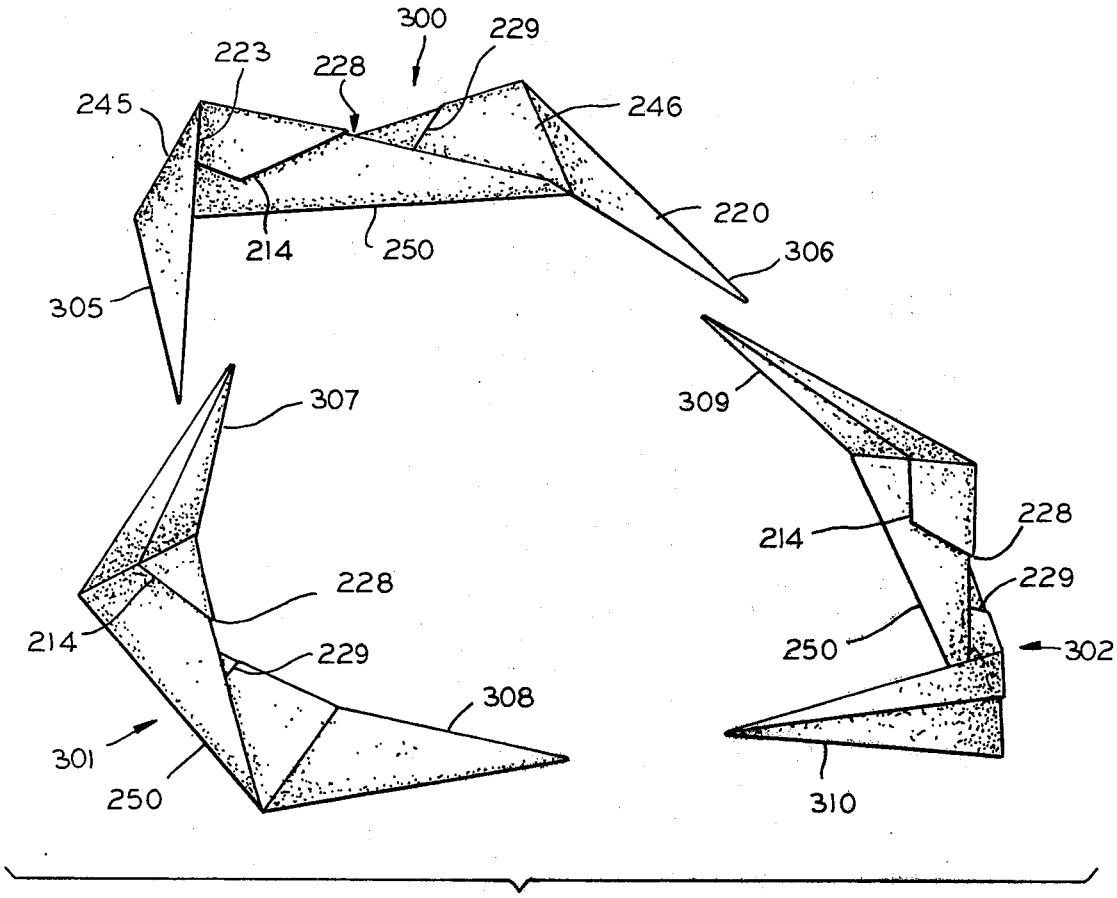
Figure 18:
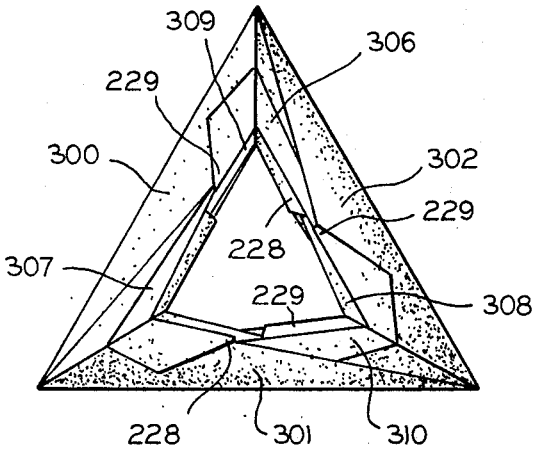
Figure 19:
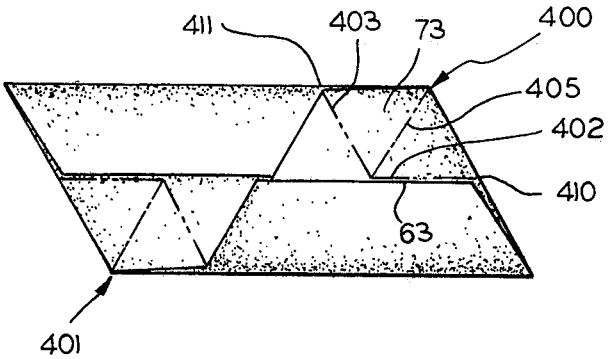
Figure 20:
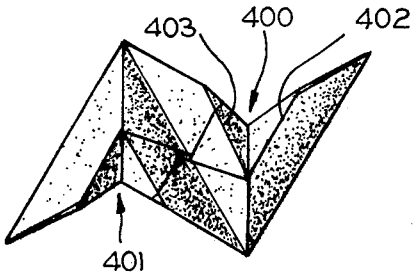

FIG. 9 schematically illustrates how a number of the modules of FIGS. 1–8 may be fitted together to form a stellated solid;

FIG. 10 is a graphical representation of how a sheet of paper, or the like, is laid out to form a basic module which provides for the construction of a pierced polyhedron;

FIGS. 11–15 are a series of sketches showing how the sheet of FIG. 10 is folded to form the basic module for pierced polyhedra;

FIG. 16 schematically illustrates how a number of the modules of FIGS. 10–15 may be assembled to form a pierced solid;

FIG. 17 shows how three modules of the FIGS. 10–15 embodiment are mountain folded and slipped together;

FIG. 18 is a bird's-eye perspective view of a pierced, solid, structural form which is assembled from the modules of FIGS. 10–15;

FIG. 19 is a plan view of the module, which is similar to the plan view of FIG. 6, showing how two additional creases may be made to transform the stellated polyhedra into pierced polyhedra;

FIG. 20 is a perspective view of the module of FIG. 19 after it is creased; and

Figure 21:
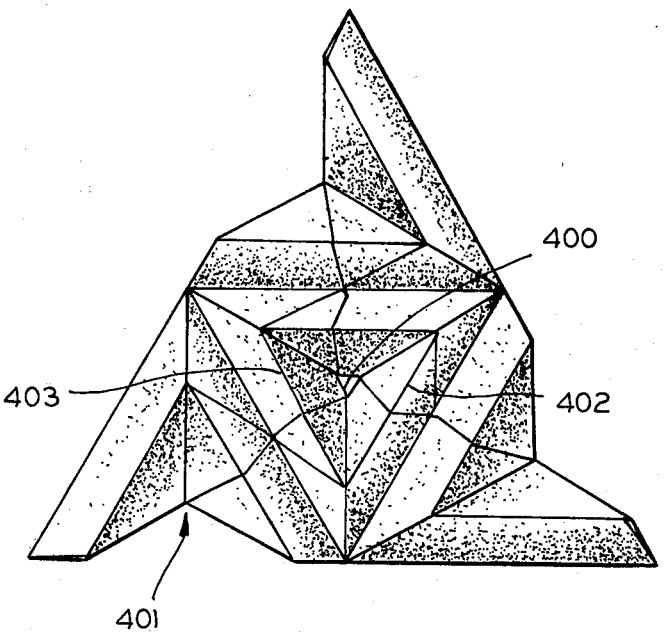

FIG. 21 is a bird's-eye view of one pierced point of a polyhedron made from the module of FIG. 20.

The sheets of paper, or the like, for two embodiments of the inventive module (FIGS. 1, 10) are essentially the same, except that with the described folds, one (FIG. 1) produces a stellated polyhedron and the other (FIG. 10) produces a pierced polyhedron. The sheet of FIG. 1 is based upon equilateral triangles and the sheet of FIG. 10 is based upon squares.

Figure 1:
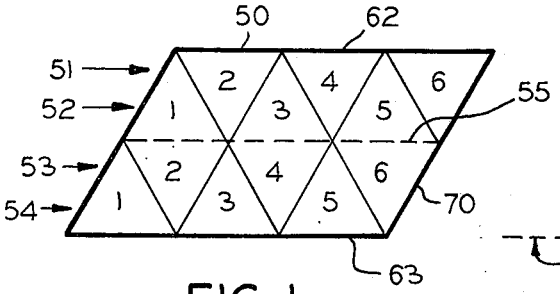
FIG. 1 is a graphical representation of how a sheet of paper, or the like, is laid out to form a basic module which provides for the construction of a stellated polyhedron.
Figure 2:
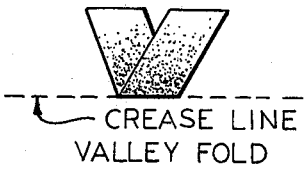
FIG. 2 is a simple sketch which explains the meaning of the term "valley fold"
Figure 3:
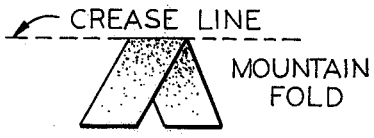
FIG. 3 is a simple sketch which explains the meaning of the term "mountain fold"
Figure 4:
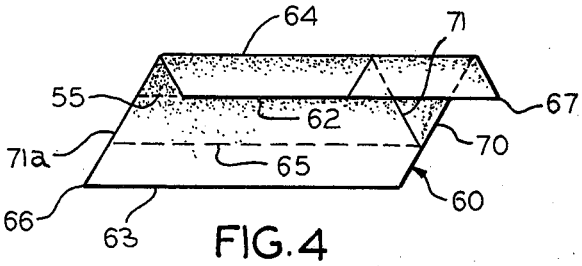
FIGS. 4–8 are a series of sketches showing how the sheet of FIG. 1 is folded to form the inventive module for stellated polyhedra.

In greater detail, the sheet of FIG. 1 is a parallelogram 50 comprising four ranks 51–54 of equilateral triangles arranged in a side-by-side relationship. The triangles in each alternate rank are inverted as compared to the triangles in the adjacent ranks. The two ranks 51, 52 on one side of a centerline 55, include six such equilateral triangles, which are individually identified by Arabic numerals in the drawing.

For this description, and conventionally, a paper is described as being "valley folded" (FIG. 2) when the fold produces a concavity and the crease line is coincident with lowest points and the edges point upwardly. The paper is described as being "mountain folded" (FIG. 3) when the crease produces a convex surface and the crease line is coincident with the points that cap the ridge or arch so formed.

The manner of forming the structural module is apparent from a study of FIGS. 4–8. First, a sheet of paper 60 (FIG. 4) is cut to the size, according to the graphical teachings of FIG. 1. Then a centerline 55 is established in any convenient manner, such as by valley folding the paper by bringing together its two long parallelogram base edges 62, 63 and creasing the paper in half by valley folding along the centerline 55 in FIG. 1.

Since the basic paper (FIG. 1) is not a right-angled parallelogram, the ends 66, 67 project out beyond the ends of the centerline 55, on the right and left, respectively.

Then the sheet of paper is opened and the parallelogram edges 62, 63 are made to coincide with the centerline 55 by creasing the paper along lines 64, 65. Next (FIG. 5) the paper is opened and the upper three-quarters of parallelogram base 70 of parallelogram 60 is brought down to lie along the crease line 65, (valley folded) and creased along the resulting line 71, thereby forming equilateral triangle 72. Then, the parallelogram base edge 63 is brought up by folding along crease line 65 so that the base of equilateral triangle 72 may lie along crease line 65 and be positioned behind the edge 63. What is now the horizontal portion of line 62 (FIG. 16) is returned to the line 55 at which time the apex triangle 73 of the triangle 72 folds down behind the layer of paper formed by the body of triangle 72.

Figure 5:
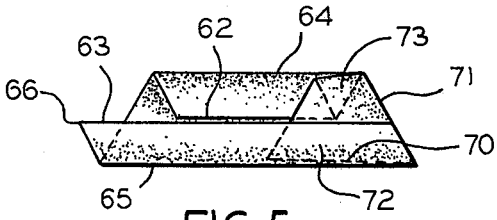

The folding process of FIG. 5 is repeated (as shown in FIG. 6) for the other end, where the lower three-quarters of the parallelogram base 71*a* is brought up to the crease line 64, valley folded, creased along line 76, and tucked in under the long base edge 62. This forms a second equilateral triangle 77 which is inverted with respect to triangle 72. The apex of the triangle is tucked in, in the same way that apex 73 was tucked in. At this time, the size of the module is reduced to approximately one-half its original size and is three-ply in thickness. The first ply is the original back of the paper, which has the centerline 55 (FIG. 4) thereon. The second ply is the two flaps defined by the crease line 64, edge 62 and by the crease line 65, edge 63. A third ply is formed by the partially exposed triangular ends 72, 77.

At this time, the three-ply form has a length equal to four side-by-side, alternately inverted, equilateral triangles (FIG. 6). Hence, the edge 76 may be creased backward to edge 65 and a mountain fold may be creased along line 78. Likewise, the edge 71 may be bent backward to edge 64 and a mountain fold may be creased along line 80. The resulting structure has two mountain folds along lines 78, 80 as shown in FIG. 7 and this structure is valley folded, in half, along a crease line 81, as shown in FIG. 8. By inspection, FIG. 8 shows a parallelogram of four triangles in series with mountain fold lines 78, 80 between the two outboard pairs of triangles and a valley fold line 81 between the two center triangles.

The module is now in the form of four side-by-side equilateral triangles, each module having two pockets for receiving the point of an adjacent module. Thus, for example, the point 82 of one module may be tucked into a pocket 83 of another module. This is done by slipping point 82 under edge 63 in the area 83.

Five modules 90–94 are shown in FIG. 9 to illustrate the basic method of assembly. Each of the modules is shown by an encoded dot-dashed line. Thus, a first module 90 is shown by chain lines having dashes and one dot. Module 91 is shown by dashes and two dots. Module 92 is shown by dashes and three dots. Module 93 is shown by dashes and four dots. A fragment of module 94 is shown by dashes and five dots.

If it is assumed that module 90 is the module shown in FIG. 8, then, the point 95 of module 91 is inserted into pocket 83 defined by the part 87 of edge 63. The point 96 of the module 92 is inserted into a similar pocket 97 of module 91. Likewise, point 98 of module 93 is inserted into pocket 99 of module 92. The next step will be to fold the assembled modules along lines 102–106 and to tuck point 100 of module 90 into the pocket 101 of module 93. When this happens, the area centered about point 107 raises to become the apex of a pyramid, or one point of a stellated polyhedron.

Thereafter, another and similar assembly is begun when point 110 of module 94 is inserted into pocket 86 on module 90. Then, the assembly process of FIG. 9 is repeated until a complete polyhedron is formed with every point of a module inserted into a pocket of another module.

The foregoing description refers to an exemplary polyhedron which can be made with the inventive module. However, the polyhedron may also be made smaller or larger. For example, perhaps only three of the modules are used to form an apex. Obviously, this would allow the construction of several polyhedra with triangular faces.

In each of the two above cases (i.e., three or four units about each apex) a regular polyhedron may be produced if every sub-assembly of modules is exactly the same as every other sub-assembly of modules. However, it does not necessarily follow that such symmetry is always required. Within reason, various combinations may be made whereby, say, three modules are used on some apices and four modules are used on others, or the faces of a polyhedron could mix these forms. This may lead to some stresses and perhaps minor asymmetry or deformation in the resulting polyhedra. However, the construction has enough give to accept the resulting asymmetrical stresses.

An advantage of this type of assembly is that the stresses inherently become apparent to a person making the assembly. Thus, for example, an architectural student may observe the stresses acting upon, say, a truss structure. Or, a chemical student may observe the nature of equilibrium stresses within a molecule when the bonding charges vary in different ways. Likewise, a student of geometry is able to observe the variations in structure between many different forms of polyhedra. A moment of reflection should make it clear how the principles of the invention have application to many different uses.

The module of FIGS. 4–9 makes a stellated polyhedron (i.e., one with pyramidal-like points). It is also desirable to produce similar polyhedra with pierced surfaces. For ease of understanding the pierced polyhedron could be thought of as a stellated polyhedron with the tops of the points cut off.

FIG. 10 shows the basic sheet of paper 200 used to make a pierced polyhedron. In greater detail, the sheet 200 is a rectangle which is twice as long L as it is wide W. Hence, the module sheet has two side-by-side squares 201, 202, divided by a centerline 203, which is formed by valley folding the paper 200.

Figure 11:
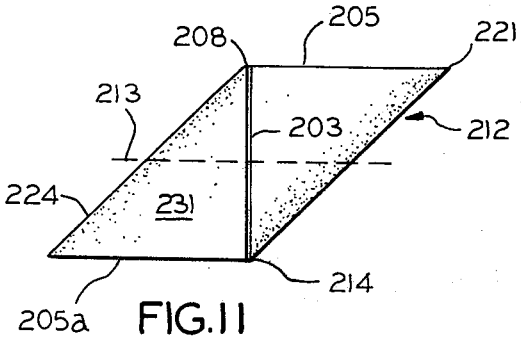
Figure 15:
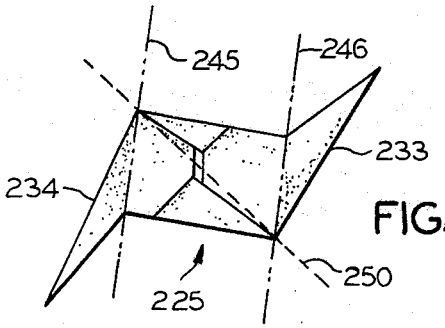

Next the side edge 205 of the sheet 200 is brought up to edge 206, with corner 207 touching the intersection 208 of centerline 203 and the top edge 206. Then, the sheet is valley folded and creased to form a diagonal crease line 210 for the square 202. Thereafter, square 201 is valley folded in a similar manner to establish a second diagonal crease line 211 across square 201, with crease lines 210, 211 being parallel to each other. With these folds, the sheet of paper 200 is formed into a parallelogram 212 as shown in FIG. 11. The resulting parallelogram 212 is valley folded to find a horizontal centerline 213. The parallelogram 212 is opened and returned to the configuration of FIGS. 11, 12.

Figure 12:
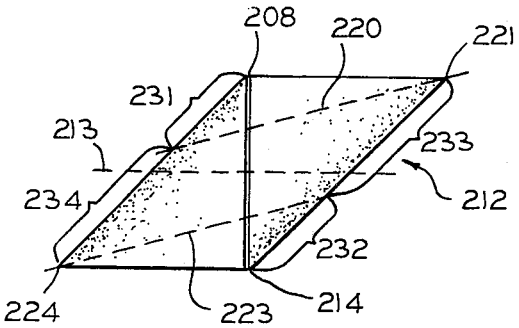

The configuration of FIG. 12 is folded so that an obtuse parallelogram angle at point 208 at the top of the vertical centerline 203 touches the horizontal centerline 213, while the acute parallelogram angle at point 221 is more or less bisected by a valley fold. The resulting valley fold crease line 220 passes through the tip 221 of the parallelogram. Then, the opposite end of the vertical line 208 (i.e., point 214) of the parallelogram is brought up to horizontal centerline 213 while the acute parallelogram angle at point 224 is more or less bisected by a valley fold. The resulting valley fold crease line 223 passes through tip 224 of the parallelogram 212 of FIG. 11.

Figure 13:
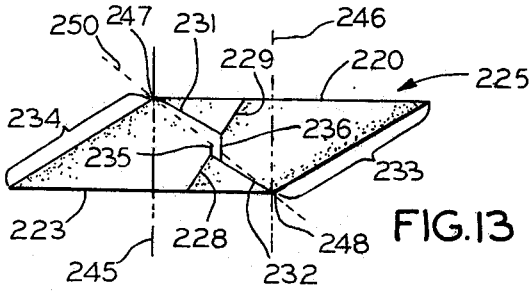

The parallelogram has now become much more acute as is apparent from a comparison of the form 212 (FIG. 12) and 225 (FIG. 13). The parallelogram is opened from form 225 to return to form 212 and a corner 226 (cross hatched) is folded under (FIG. 14) between edge 205 and the intersection of vertical and horizontal centerlines 203, 213, to prevent snagging during assembly. A similar corner 227 is folded under at the bottom point 214. The areas of sections 226, 227 and the angles of fold lines 228, 229 are not critical. The resulting mountain fold crease lines 228, 229 may have any convenient angle with respect to centerline 213.

Figure 14:
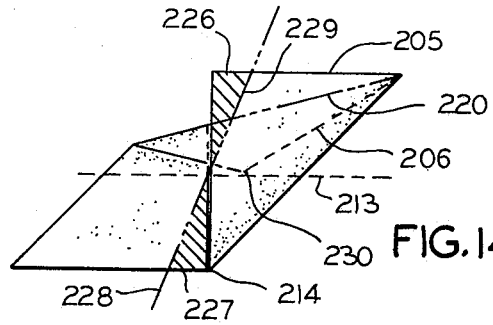

The module is unfolded so that it again appears as seen in FIGS. 12 and 14, wherein it is basically in the first or less acute parallelogram configuration 212 with the vertical corners folded under, along crease lines 228, 229. The obtuse parallelogram corner 230 is on the edge 206 of the triangular panel which was folded along line 220 of FIG. 12. Therefore, edge 205 may be lifted, thereby tending to unfold the triangular panel and return toward the configuration of FIG. 10. At this time, the point 208 at the top of the vertical centerline is brought down to re-establish the crease line 220 and to move an obtuse corner to position 230. Then, the triangular panel, having edge 205, is folded back to the configuration of FIG. 13. Thereafter, the corner of this triangular panel is folded over the back of the module with a crease forming along and over the crease line 220. The same process is repeated at the bottom of the vertical line 203 so that the lowermost point 214 is positioned under the triangular panel 231, while the lowermost point of triangle 231 folds over the back of the module.

These folds will become more apparent by comparison of reference numerals on the front view (FIG. 13) and the other views (FIGS. 11, 12, 14).

The module is completed by mountain folding along lines 245, 246. Line 245 is established by mountain folding from the upper parallelogram angle 247, with edge 223 being in registry along the fold-back region. Likewise, the line 246 is mountain folded from the lower parallelogram angle 248 with the edge 220 folding back upon itself, in registry. Then, the valley fold line 250 is formed along a diagonal of a rectangle defined on its ends by the mountain fold lines 245, 246 and the parallelogram angles 247, 248. The module now has an appearance seen in FIG. 15. By inspection of FIG. 15, the acute parallelogram 225 comprises a series of four triangles with mountain folds along lines 245, 246 between the two pairs of outboard triangles and a valley fold along the line 250 between the two center triangles.

FIG. 16 is similar to FIG. 9 in that it shows four separate modules respectively identified by chained or dot-dashed lines, with the individual modules designated by the number of dots. Here the assembly begins with the first (one dot) module 260 having a pocket 262 into which a point of a second (double dot) module 261 is slipped. The point of a third (three dot) module 263 is slipped into pocket 265 on module 260. The point of a fourth (four dot) module 266 is slipped into pocket 267 on the third module 261.

The modules are folded along the valley fold lines 250 and the mountain fold lines 245, 246 (FIG. 15), and end point 270 on first module 260 is slipped into pocket 271 on fourth module 266. As this assembly step is completed, the modules bend along mountain folds 245, 246 and valley creases 250 so that an upstanding, three-sided, truncated pyramid is formed. A triangular opening is thus formed along the edges 273, 274, 275, and the resulting polyhedron is properly described as being "pierced".

Again, the polyhedron may be made larger or smaller by adding or subtracting modules. As long as the resulting structure includes a uniform number of modules, the various stresses are also uniform. However, if a few modules are deleted, the various stresses are not uniform and the builder learns much about the polyhedron which he is building.

The module of FIGS. 10–15 offers an interesting possibility for making structures such as geodesic domes. In greater detail, the form of the module described in connection with FIG. 15 leads to a somewhat Z-shaped cross section because lines 245, 246 are mountain folds and line 250 is valley folded. However, if the module is valley folded along line 246, the cross section becomes somewhat U-shaped, as seen in FIG. 17. Then, three of these U-shaped modules 300, 301, 302 may be slipped together to form a three-sided truncated pyramid, which might be thought of as a rosette of modules. The resulting structure may be used to form one basic module of a geodesic dome, or the like, in metal or other materials.

The various lines in FIG. 17 may be identified by comparing the reference numerals with those in FIGS. 10–16. Point 305 on module 300 fits into the valley of the fold 250, and into pocket 229 of module 301. Point 306 fits into the valley of fold 250, and into pocket 229 of module 302. Point 307 fits into the valley of fold 250, and into pocket 229 of module 300. Point 308 fits into valley fold 250 and into pocket 228 of module 302. Point 310 fits into the valley of fold 250, and into pocket 228 of module 301. Point 309 fits into the valley of fold 250, and into pocket 228 of module 300.

When the foregoing insertions are made, every valley fold 250 encaptures two of the points, which are further confined within either a pocket 228 or 229. This way, the various panels can move into position without distorting the metal, or other material, confining it. The end result is that extremely thin sheet material becomes extremely strong, and the rosette of modules of FIG. 18 can absorb and withstand extremely heavy loads without deformation. Moreover, the rosette of modules is extremely interesting and attractive to the view. Accordingly, structures (such as geodesic domes) made of these rosettes of modules would be both attractive and strong, and they may be made of extremely thin material.

When the rosette of modules is made of any material, securing a single spot in each unit is easily effected (as where the lead lines 300–302 end). These spots will hold the modules securely together without destroying the attractive appearance of the rosette.

The advantages of the invention should now be clear. Almost any convenient number of modules may be put together to make almost any convenient and amazing array of forms. More specifically, the assembled configurations of FIGS. 9 and 16 are somewhat reminiscent of a pin wheel, which means that there is room to insert fewer or more modules. Stated another way, the assembly of modules does not inherently close upon itself as an inherently small polyhedron, such as a four-sided solid, for example. If the configuration should be mutually perpendicular, in the form of a cross, it would not be possible to enlarge the polyhedron because the assembly would inherently become a flat mat. Or, if in some manner, modular parts are forced together, the polyhedron would quickly close upon itself so that only a very small polyhedron could be made.

The great versatility and flexibility of the modules enables a construction of a great variety of different polyhedrons, a few of which are, as follows:

1. Tetrahedron
2. Hexahedron
3. Octahedron
4. Icosohedron
5. Archimedian Prism
6. Cuboctohedron
7. Small Rhombicuboctahedron
8. Snub Cube
9. Bicubic Dodecahedron
10. Trigonal Dodecahedron
11. Right Trigonal Prism
12. All 8 (and probably a 9th) Convex Deltahedron Most books on the construction of polyhedra say that only eight convex deltahedra may be constructed — see *Shapes, Space and Symmetry*, by Alan Holden, Columbia University Press, New York & London, 1971. Nevertheless, I am convinced that the inventive modules may be assembled to exceed these limits.

FIGS. 19–21 show how a stellated polyhedron may be converted into a pierced polyderon. For this conversion, the basic module of FIG. 6 is further creased on opposite obtuse corners 400, 401. A first crease line 402 is mountain folded (one dash and two dots) parallel to edge 63. A second crease line 403 is mountain folded simultaneously along the inboard side of the apex triangle 73. Also simultaneously, with these two mountain folds, a center crease line 405 is valley folded (one dash and one dot) between corner 400 and the intersection of mountain fold lines 403, 402. These folds may be made quickly and easily by bringing the corners 410, 411 together, pushing in along line 405, and creasing, thereby forming concave pockets.

After these corner folds are made, the mountain and valley folds are made along lines 78, 80, 81, as described above in connection with FIG. 8. At this time, the module appearance is, as shown in FIG. 20. Then, a plurality of these modules may be joined together, as disclosed in FIG. 9. Therefore, instead of corners 400, 401 forming upstanding stellations, they fold inwardly to form pierced regions, as seen in FIG. 21.

These are exemplary of many other modifications which will readily occur to those skilled in the art. Therefore, the appended claims are to be construed to cover all equivalent structures falling within the true scope and spirit of the invention.

I claim:

1. A modular form made from material including a pair of oppositely directed points and a plurality of interior pockets, the points and pockets having complementary and non-perpendicular configurations, whereby a point on one module fits into a pocket on another module with said modules fitting together in a non-perpendicular configuration, said modular form fitting together in an open assembled configuration which does not inherently close upon itself in polyhedra with six or less faces.

2. The modular form of claim 1 wherein said module is folded to produce a stellated polyhedron when a plurality of modules are assembled together.

3. The modular form of claim 1 wherein said module is folded to produce a pierced polyhedron when a plurality of modules are assembled together.

4. The module of claim 1 wherein said material is a sheet folded into a basic parallelogram defined by at least four triangles in series, with mountain folds between two outboard pairs of triangles and a valley fold between two center triangles.

5. The module of claim 1 wherein said material is a sheet which begins as an unfolded parallelogram comprising four side-by-side ranks of equilateral triangles, with triangles of adjacent ranks being inverted with respect to each other.

6. The module of claim 5 wherein said parallelogram has upper and lower long bases with short bases at the ends of said long bases and is valley folded to bring together the upper and lower long bases at the horizontal centerline of the parallelogram.

7. The module of claim 6 wherein each of said short bases is folded adjacent an individually associated one of the valley fold lines to form oppositely directed equilateral triangles, with the equilater triangle base tucked under the long base edge forming the associated one of the valley fold lines, whereby four alternately opposite pockets are formed for receiving the four points on said modules.

8. The module of claim 1 wherein said sheet of material is folded into a basic parallelogram defined by at least four triangles in series, with mountain folds between two outboard triangles and a valley fold between two center triangles.

9. The module of claim 1 wherein said sheet of material begins as an unfolded rectangle which is approximately twice as long as it is wide, which is initially folded in two spaced parallel angular folds, one of said angular folds beginning at the center of one long edge of said rectangle and extending to one corner at the opposite long edge of the rectangle, and the other of said angular folds beginning at the center of the opposite long edge and extending to the corner of said rectangle which is diametrically opposed to said one corner.

10. The module of claim 9 wherein said spaced parallel folds form said sheet of material into a first parallelogram, and means for further folding said first parallelogram into a smaller, more acute parallelogram, wherein a first obtuse angle of said first parallelogram is valley folded down to the horizontal centerline of said parallelogram to form a crease line which more or less bisects a first acute angle of said first parallelogram, the second obtuse angle of said first parallelogram is valley folded up to the horizontal centerline of said parallelogram to form a crease line which more or less bisects the acute parallelogram angle diametrically opposed to said first acute angle.

11. The module of claim 10 wherein said sheet of material is folded into a basic parallelogram defined by at least four triangles in series, with mountain folds between two outboard pairs of triangles and a valley fold between two center triangles.

12. The module of claim 10 wherein said sheet of material is folded into a basic parallelogram defining at least four triangles in series, with a mountain fold between two outboard pairs of triangles and valley folds between the other two outboard triangles and the two center triangles.

13. The module of claim 12 and a rosette of said modules being formed by placing the points of each module in an adjacent module, said points being put into the adjacent module valley of the fold, between the two center triangles and into a pocket formed on said adjacent module, there being at least three modules so that said rosette becomes a completely solid geometric form.

14. The module of claim 1 wherein said module is a parallelogram form haing opposite obtuse angles, each of which is folded inwardly to form concave pockets, whereby a stellated polyhedron is converted into a pierced polyhedron.

* * * * *